US008141618B2

(12) United States Patent
Blejde et al.

(10) Patent No.: US 8,141,618 B2
(45) Date of Patent: Mar. 27, 2012

(54) STRIP CASTING METHOD FOR CONTROLLING EDGE QUALITY AND APPARATUS THEREFOR

(75) Inventors: Walter N. Blejde, Brownsburg, IN (US); Mark Schlichting, Crawfordsville, IN (US)

(73) Assignee: Nucor Corporation, Charlotte, NC (US)

( * ) Notice: Subject to any disclaimer, the term of this patent is extended or adjusted under 35 U.S.C. 154(b) by 220 days.

(21) Appl. No.: 12/214,913

(22) Filed: Jun. 24, 2008

(65) Prior Publication Data

US 2009/0314459 A1 Dec. 24, 2009

(51) Int. Cl.
*B22D 11/06* (2006.01)

(52) U.S. Cl. ..... 164/480; 164/428

(58) Field of Classification Search ..... 164/480, 164/428

See application file for complete search history.

(56) References Cited

U.S. PATENT DOCUMENTS

| | | | | |
|---|---|---|---|---|
| 6,003,589 | A | 12/1999 | Folder | |
| 6,079,480 | A * | 6/2000 | Oka et al. | 164/452 |
| 6,536,506 | B2 | 3/2003 | Nikolovski | |
| 6,973,956 | B2 | 12/2005 | Hohenbichler et al. | |
| 2009/0090484 | A1 | 4/2009 | d'Hone et al. | |

FOREIGN PATENT DOCUMENTS

| | | | |
|---|---|---|---|
| EP | 0107970 | A1 | 10/1983 |
| EP | 0788854 | B1 | 6/2008 |
| JP | 59-99050 | | 7/1984 |
| JP | 59-118249 | | 7/1984 |
| JP | 59-118250 | | 7/1984 |
| JP | 60-054249 | | 3/1985 |
| JP | 61-037354 | | 2/1986 |
| JP | 5-277648 | | 10/1993 |
| JP | 5-277648 | A * | 10/1993 |
| WO | 2005025773 | A2 | 3/2005 |
| WO | 2005025775 | A1 | 3/2005 |
| WO | 2008/010644 | A1 | 1/2008 |
| WO | 2008106744 | A1 | 9/2008 |

OTHER PUBLICATIONS

AU2008904316 International Search Report.

Lindenberg, H.U., et al. Europstrip (R)—State of the Art of Strip Casting, Revue de Metallugie, Paris, No. 7-8 (Jul.-Aug. 2002) pp. 615-627, France, DOI: 10.1051/metal:2002201.

* cited by examiner

*Primary Examiner* — Kevin P Kerns

(74) *Attorney, Agent, or Firm* — Hahn, Loeser & Parks LLP; Arland T. Stein

(57) ABSTRACT

A method of continuously casting metal strip may include assembling a pair of casting rolls having casting surfaces laterally positioned to form a nip therebetween through which thin cast strip may be cast, a metal supply system capable of delivering molten steel above the nip, the casting rolls having a crown shape so that edge portions of the cast strip within 50 millimeters of edge of the cast strip have a higher temperature than the cast strip in center portions of the strip width and controlled edging up, forming a casting pool of molten steel supported on the casting surfaces above the nip and controlling side dams adjacent the ends of the nip to confine the casting pool, and forming a cast strip such that the edge portions of the cast strip within 50 millimeters of each edge of the cast strip is of a higher temperature than the strip in the center portions of the strip width.

18 Claims, 13 Drawing Sheets
(2 of 13 Drawing Sheet(s) Filed in Color)

STRIP CASTING METHOD FOR CONTROLLING EDGE QUALITY AND APPARATUS THEREFOR

BACKGROUND AND SUMMARY

This invention relates to the casting of metal strip by continuous casting in a twin roll caster.

In a twin roll caster molten metal is introduced between a pair of counter-rotated horizontal casting rolls that are cooled so that metal shells solidify on the moving roll surfaces and are brought together at a nip between them to produce a solidified strip product delivered downwardly from the nip between the rolls. The term "nip" is used herein to refer to the general region at which the rolls are closest together. The molten metal may be poured from a ladle into a smaller vessel or series of smaller vessels from which it flows through a metal delivery nozzle located above the nip, so forming a casting pool of molten metal supported on the casting surfaces of the rolls immediately above the nip and extending along the length of the nip. This casting pool is usually confined between side plates or dams held in sliding engagement with end surfaces of the rolls so as to dam the two ends of the casting pool against outflow.

Further, the twin roll caster may be capable of continuously producing cast strip from molten steel through a sequence of ladles. Pouring the molten metal from the ladle into smaller vessels before flowing through the metal delivery nozzle enables the exchange of an empty ladle with a full ladle without disrupting the production of cast strip.

During casting, the casting rolls rotate such that metal from the casting pool solidifies into shells on the casting rolls that are brought close together at the nip to produce a solidified cast strip below the nip. The gap between the casting rolls is such as to maintain separation between the solidified shells at the nip so that semi-solid metal is present in the space between the shells through the nip, and is, at least in part, subsequently solidified between the solidified shells within the cast strip below the nip.

When semi-solid metal between the shells below the nip is mushy, the metal can drip from the edges of the cast strip. This is known as "edge loss." Even before edge loss occurs, the latent heat of the mushy metal can also cause reheating, and through the effect of the ferrostatic head of the pool, enlargement of the edge portions of the strip. This is referred to as "edging up" and "edge bulge." To avoid such edging up and edge loss, it was previously proposed to shape the crown of the casting roll to squeeze the shells forming the strip at the edges, and alternatively or in addition, alter the cooling rate, so that solid fraction at the center of the strip within 50 millimeters of the edge of the strip is greater than the fluid critical solid fraction of the metal. See U.S. Pat. No. 6,079,480 and EP 0788854. These approaches involved lowering the temperature of the cast strip within 50 millimeters of the strip edges so the edges of the strip do not contain mushy metal. The '480 patent defines the fluid critical solid fraction as the solid fraction (i.e., the solid phase per unit volume at the center of the strip thickness) does not have fluidity and begins to have strength. This approach also reduced loss of metal from additional edge trimming due to edging up, and thus increasing process efficiency.

The present disclosure provides a completely different approach to improving edge quality during casting by purposely allowing and controlling edging up or edge bulge within 50 millimeters of the strip edges. We have found that the temperature of the strip near the edges can be increased relative to the center portion of the strip width when the metal between the shells near the edges of the cast strip is mushy, i.e., the metal has fluidity and causes edging up of the thin cast strip. We have found that maintaining a higher temperature at the edge portion and controlling edging up improves the edge quality of the cast strip. A method is disclosed for continuously casting metal strip comprising steps of:

- assembling a pair of counter-rotatable casting rolls having casting surfaces laterally positioned to form a nip therebetween through which thin cast strip may be cast, a metal supply system capable of delivering molten steel above the nip,
  - the casting rolls having a crown shape so that edge portions of the cast strip within 50 millimeters of edge of the cast strip have a higher temperature than the cast strip in center portions of the strip width;
- forming a casting pool of molten steel supported on the casting surfaces above the nip in a casting area and controlling side dams adjacent the ends of the nip to confine the casting pool; and
- forming a cast strip such that the edge portions of the cast strip within 50 millimeters of each edge of the cast strip is of a higher temperature than the cast strip in the center portions of the strip width.

The temperature of the strip may be measured at the surfaces of the edge portions and the center portion of the strip by a pyrometer(s). The temperature of the edge portions of the cast strip may be about 10° C. or more higher than the cast strip in the center portions of the strip width. Alternately or in addition, the temperature of edge portions of the cast strip may be about 25° C. or more higher than the cast strip in the center portions of the strip width, or may be about 50° C. or more higher than the cast strip in the center portions of the strip width.

The method may include the step of forming the cast strip such that the center portions of the strip within 50 millimeters (about 2 inches) of each edge of the cast strip have a mushy metal between solidified shells. Alternately, the center portions of the strip within 60 millimeters (about 2.4 inches) of each edge of the cast strip may have a mushy metal between the shells. The edge portions of the cast strip may have a higher temperature within about 60 millimeters of edges of the cast strip than the strip in center portions of the strip width. Further, the method may include the step of controlling the amount of mushy metal between the shells below the nip to control and maintain a limited edging up or edge bulge as desired. Such edging up typically may be rolled out at a hot rolling mill downstream of the casting rolls.

The method of continuously casting metal strip may include the step of controlling a groove formed into at least one side dam by the cast strip by the edge of cast strip during casting to a depth of less than about 2.5 millimeters (about 0.098 inch). Alternately, the method may include controlling the groove to less than about 1.5 millimeters (about 0.059 inch) in depth. Alternately or in addition, the method may include the step of causing the side dam actuator to move the side dam toward the end of the casting rolls when a groove formed in at least one side dam by the cast strip during casting is greater than about 2.5 millimeters. Such side dam wear can be controlled to inhibit edge loss.

An apparatus is disclosed for continuously casting metal strip comprising:

- a pair of counter-rotatable casting rolls having casting surfaces laterally positioned to form a nip therebetween through which thin cast strip may be cast, the casting rolls having a crown shape so that each edge portion of the cast strip within 50 millimeters of edge of the cast strip have a higher temperature than the cast strip in center portions of the strip width; and a metal delivery system capable of delivering molten steel above the nip and forming a casting pool of molten steel supported on the casting surfaces above the nip in a casting area;

a side dam adjacent each end of the casting rolls at the nip to confine the casting pool; and a side dam actuator at each end of the casting rolls capable of positioning the side dams during casting and controlling a groove formed into at least one side dam by the cast strip during casting to less than about 2.5 millimeters.

The crown shape of the casting rolls may be capable of forming a cast strip of steel such that the edge portions of the cast strip within 50 millimeters of each edge of the cast strip is of a higher temperature than the cast strip in the center portions of the strip width. Alternately or in addition, the crown shape of the casting rolls in conjunction with the shell thickness at the nip and casting roll biasing force is capable of forming the cast strip such that edge portions of the strip within 50 millimeters of each edge of the cast strip has mushy metal between the shells to cause edging up.

The crown shape of the casting rolls in combination with the casting roll biasing force may be capable of forming a cast steel strip such that the edge portions of the cast strip may have a higher temperature within about 60 millimeters of edges of the cast strip than the strip in center portions of the strip width. The temperature of the edge portions of the cast strip may be about 10° C. or more higher than the cast strip in the center portions of the strip width. Alternately or in addition, the temperature of edge portions of the cast strip may be about 25° C. or more higher than the cast strip in the center portions of the strip width, or may be about 50° C. or more higher than the cast strip in the center portions of the strip width.

Each side dam actuator may be capable controlling the wear rate of the side dam to control the depth of the groove to less than 2.5 millimeters or 1.5 millimeters to reduce and control edge loss.

BRIEF DESCRIPTION OF THE DRAWINGS

The patent or application file contains at least one drawing executed in color. Copies of this patent with color drawing(s) will be provided by the Patent and Trademark Office upon request and payment of necessary fee.

The accompanying drawings assist in describing illustrative embodiments of the present disclosure, in which.

DETAILED DESCRIPTION OF THE DRAWINGS

Figure 1:
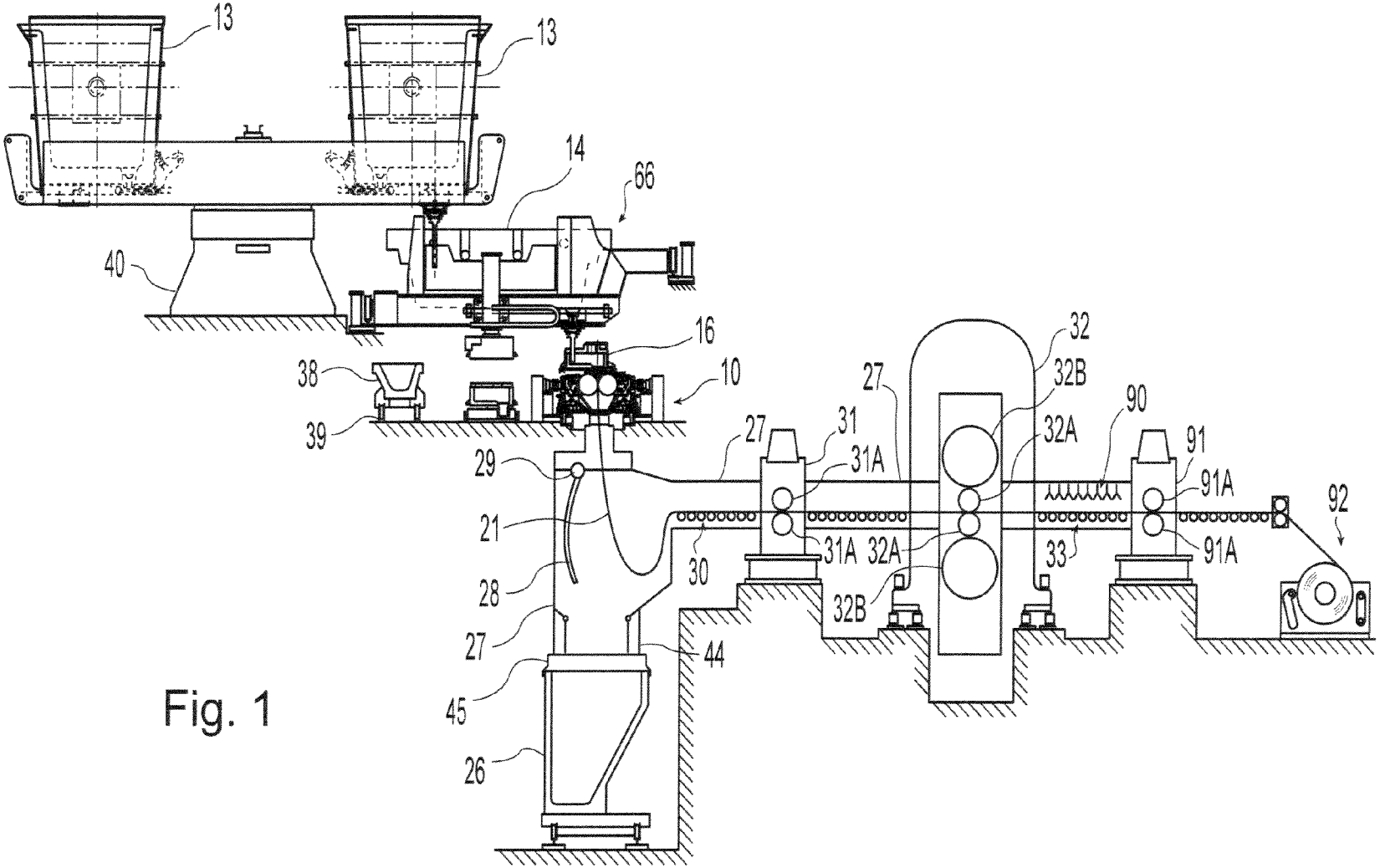
FIG. 1 is a diagrammatical side view of a twin roll caster of the present disclosure.
Figure 2:
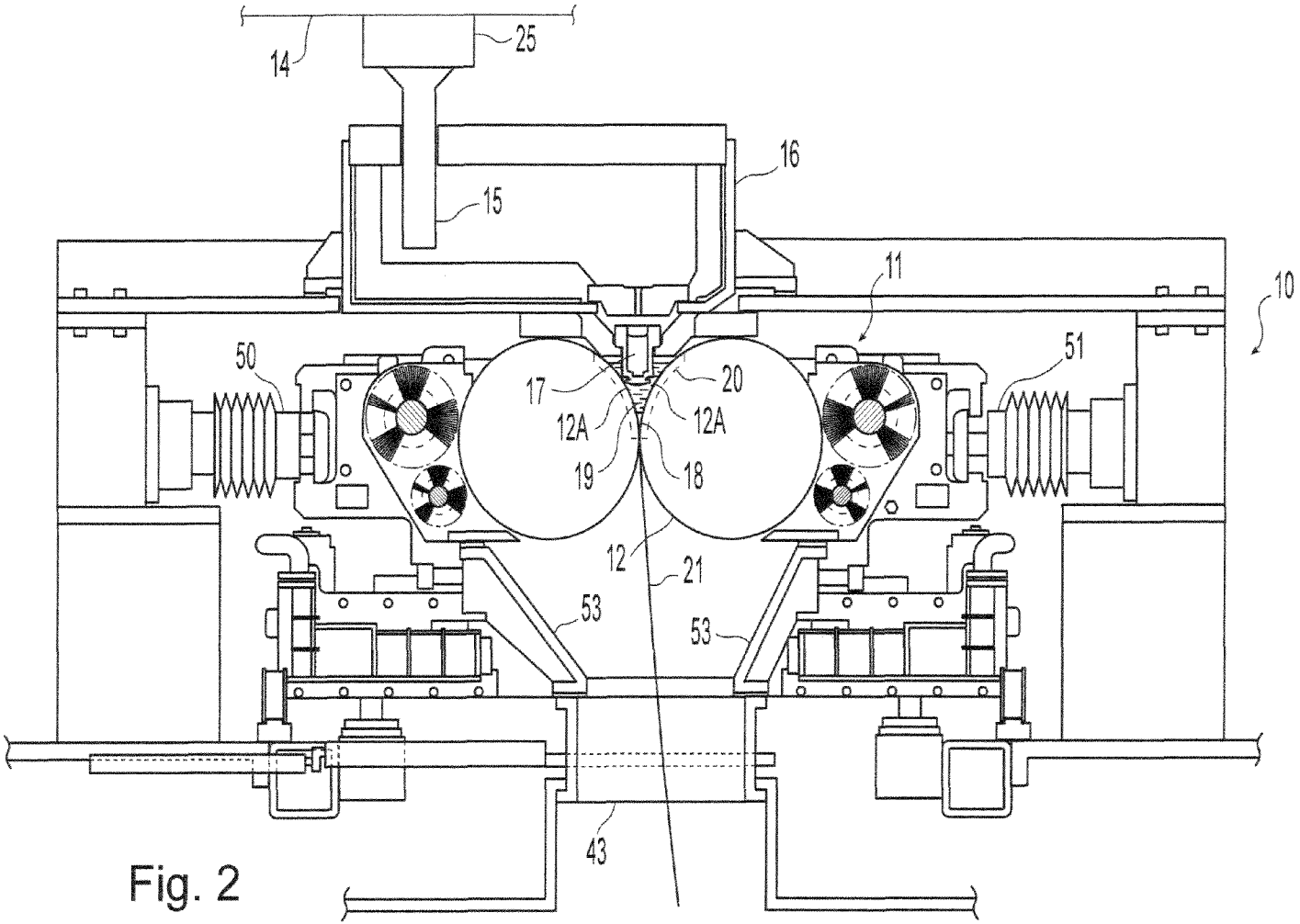
FIG. 2 is a partial sectional view through casting rolls mounted in a roll cassette in the casting position of the present disclosure.
Figure 3:
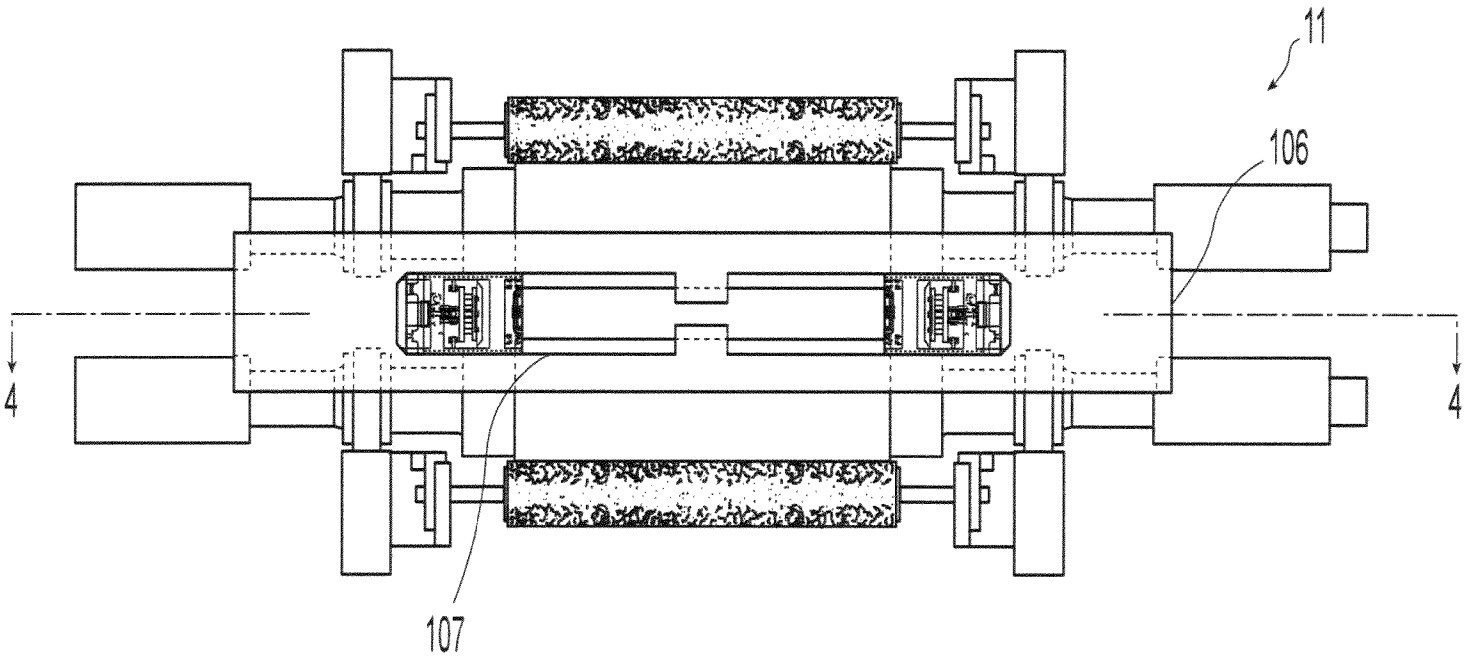
FIG. 3 is a diagrammatical plan view of the roll cassette of FIG. 2 removed from the caster.

Referring now to FIGS. 1 and 2, a twin roll caster is illustrated that comprises a main machine frame 10 that stands up from the factory floor and supports a pair of casting rolls mounted in a module in a roll cassette 11. The casting rolls 12 are mounted in the roll cassette 11 for ease of operation and movement as described below. The roll cassette facilitates rapid movement of the casting rolls ready for casting from a setup position into an operative casting position in the caster as a unit, and ready removal of the casting rolls from the casting position when the casting rolls are to be replaced. There is no particular configuration of the roll cassette that is desired, so long as it performs that function of facilitating movement and positioning of the casting rolls as described herein.

The casting apparatus for continuously casting thin steel strip includes a pair of counter-rotatable casting rolls 12 having casting surfaces 12A laterally positioned to form a nip 18 therebetween. Molten metal is supplied from a ladle 13 through a metal delivery system to a metal delivery nozzle 17, core nozzle, positioned between the casting rolls 12 above the nip 18. Molten metal thus delivered forms a casting pool 19 of molten metal above the nip supported on the casting surfaces 12A of the casting rolls 12. This casting pool 19 is confined in the casting area at the ends of the casting rolls 12 by a pair of side closure plates, or side dams 20, (shown in dotted line in FIG. 2). The upper surface of the casting pool 19 (generally referred to as the "meniscus" level) may rise above the lower end of the delivery nozzle 17 so that the lower end of the delivery nozzle is immersed within the casting pool. The casting area includes the addition of a protective atmosphere above the casting pool 19 to inhibit oxidation of the molten metal in the casting area.

The ladle 13 typically is of a conventional construction supported on a rotating turret 40. For metal delivery, the ladle 13 is positioned over a movable tundish 14 in the casting position to fill the tundish with molten metal. The movable tundish 14 may be positioned on a tundish car 66 capable of transferring the tundish from a heating station (not shown), where the tundish is heated to near a casting temperature, to the casting position. A tundish guide, such as rails, may be positioned beneath the tundish car 66 to enable moving the movable tundish 14 from the heating station to the casting position.

The movable tundish 14 may be fitted with a slide gate 25, actuable by a servo mechanism, to allow molten metal to flow from the tundish 14 through the slide gate 25, and then through a refractory outlet shroud 15 to a transition piece or distributor 16 in the casting position. From the distributor 16, the molten metal flows to the delivery nozzle 17 positioned between the casting rolls 12 above the nip 18.

The casting rolls 12 are internally water cooled so that as the casting rolls 12 are counter-rotated, shells solidify on the casting surfaces 12A as the casting surfaces move into contact with and through the casting pool 19 with each revolution of the casting rolls 12. The shells are brought close together at the nip 18 between the casting rolls to produce a thin cast strip product 21 delivered downwardly from the nip. The gap between the casting rolls is such as to maintain separation between the solidified shells at the nip so that mushy metal is present in the space between the shells through the nip, and is, as described below with edging up, subsequently solidified between the solidified shells within the cast strip below the nip.

Figure 6:
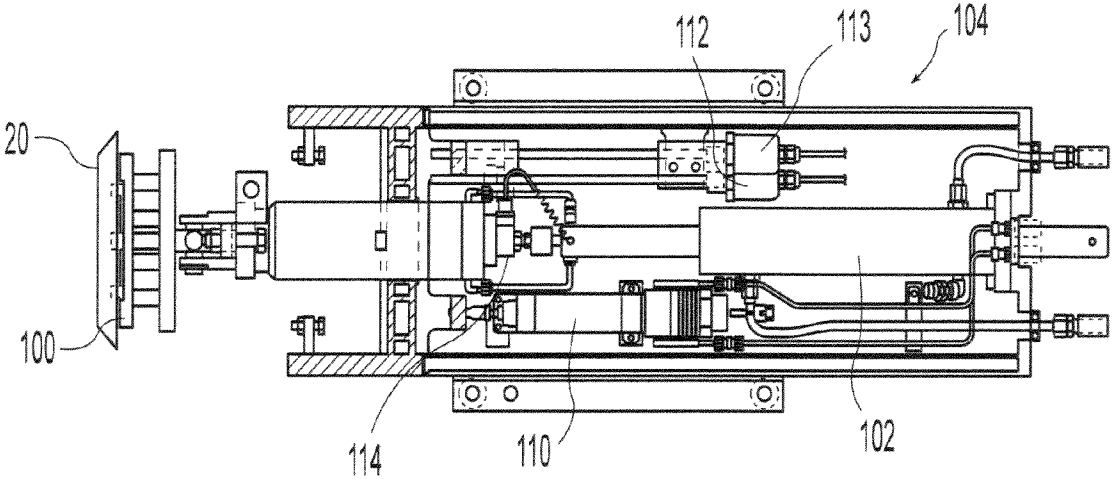
FIG. 6 is a plan view of the side dam carriage of the present disclosure removed from the caster.
Figure 7:
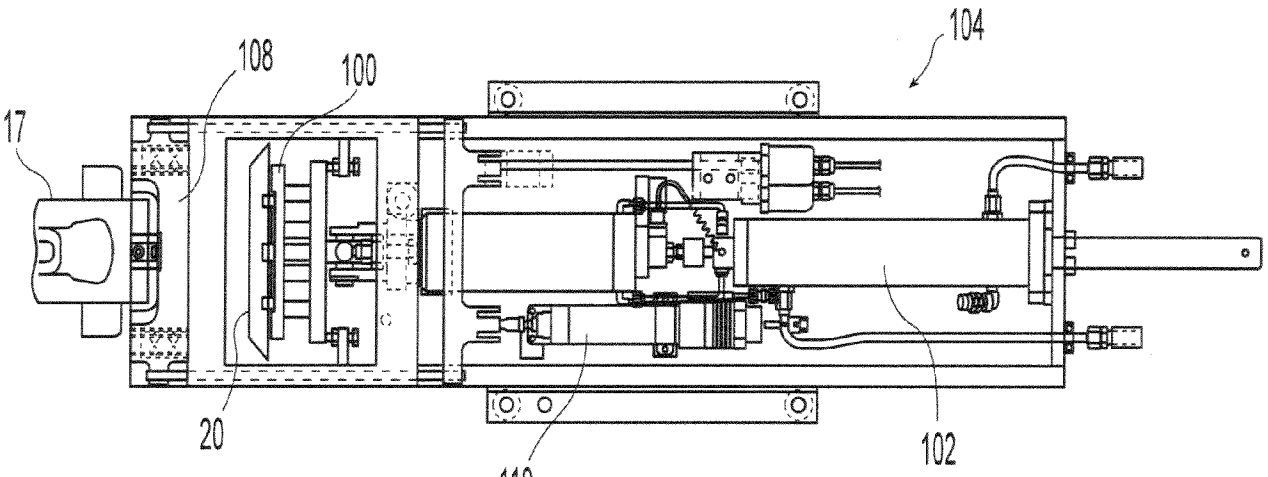
FIG. 7 is a sectional view of the side dam carriage through the section marked 7-7 in FIG. 5.
Figure 14B:
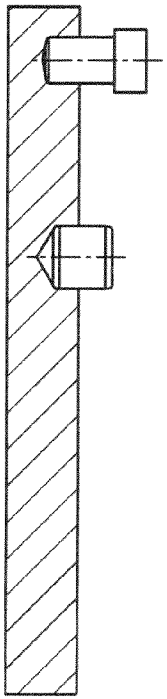
FIG. 14B is a sectional view through the side dam of FIG. 14A.
Figure 14A:
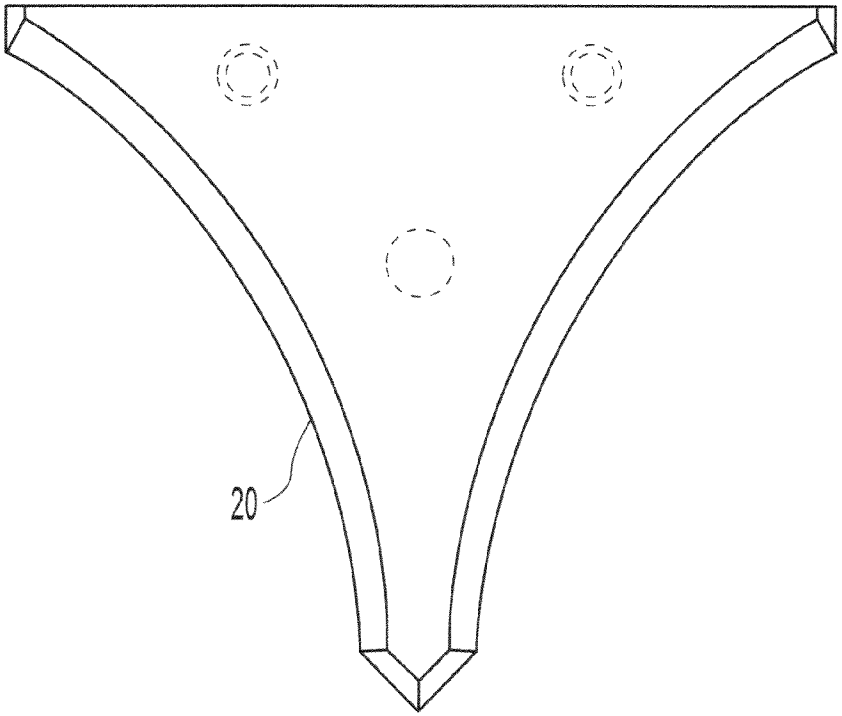
FIG. 14A is a plan view of a side dam.

The side dams 20, shown in FIGS. 14A and 14B, may be made from a refractory material such as zirconia graphite, graphite alumina, boron nitride, boron nitride-zirconia, or other suitable composites. The side dams 20 have a face surface capable of physical contact with the casting rolls and molten metal in the casting pool. As shown in FIGS. 6 and 7, the side dams 20 are mounted in side dam holders 100, which are movable by side dam actuators 102, such as a hydraulic or pneumatic cylinder, servo mechanism, or other actuator to bring the side dams 20 into engagement with the ends of the casting rolls. Additionally, the side dam actuators 102 are capable of positioning the side dams 20 during casting. The side dams 20 form end closures for the molten pool of metal on the casting rolls during the casting operation.

Figure 4:
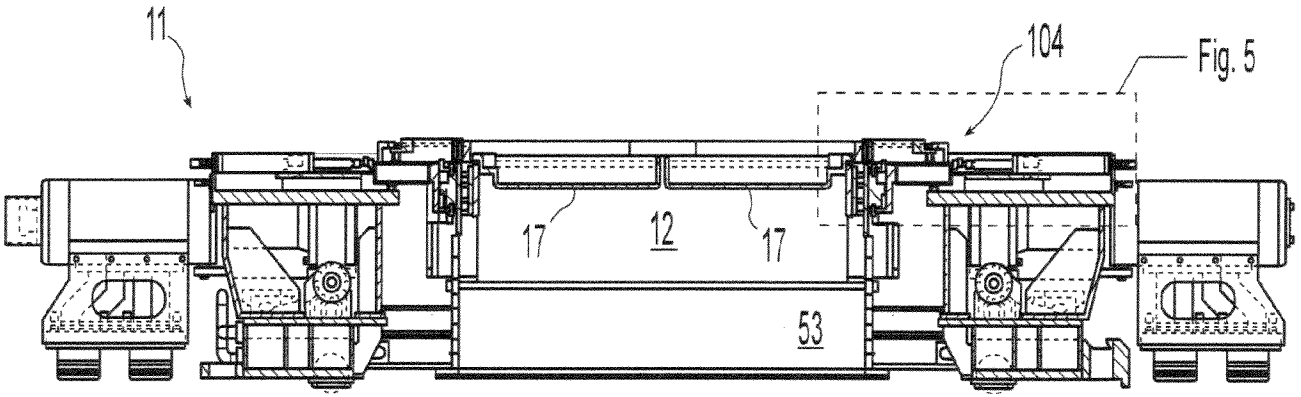
FIG. 4 is a partial sectional view of the roll cassette removed from the caster through the section marked 4-4 in FIG. 3.
Figure 5:
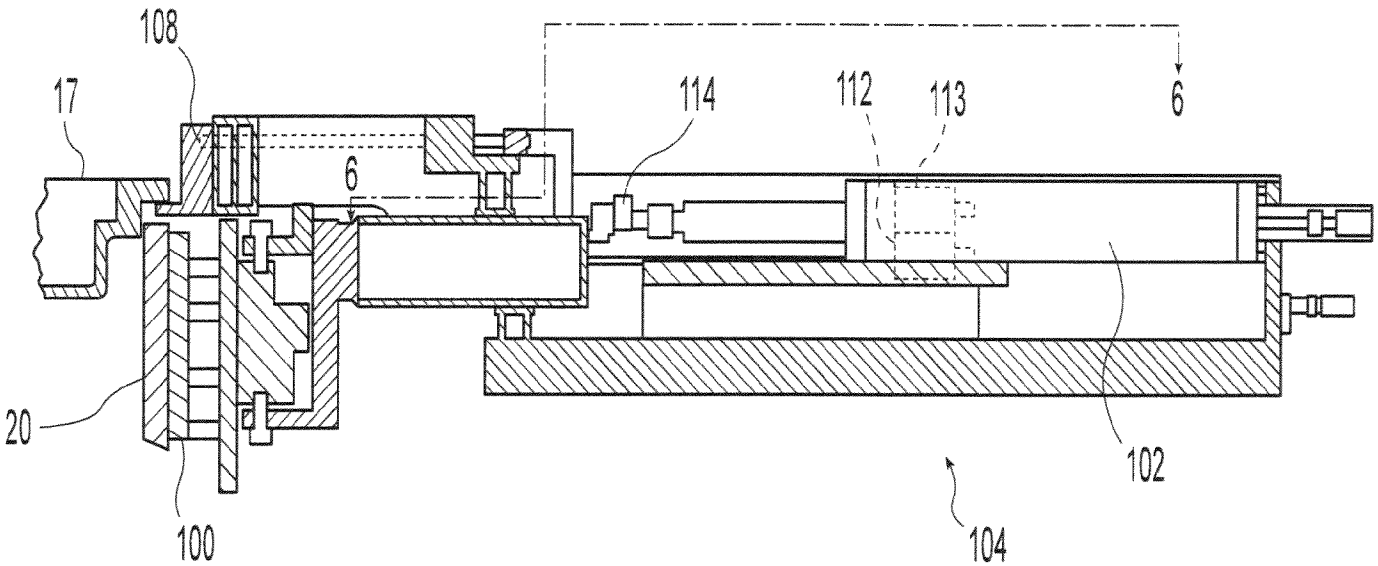
FIG. 5 is a detail showing the partial sectional view of the side dam carriage of the present disclosure removed from the caster marked as Detail 5 in FIG. 3.

Referring now to FIGS. 3 through 7, the side dam holders 100 and side dam actuators 102 are mounted on a pair of carriages 104 positioned one at each end of the roll assembly and moveable toward and away from one another to enable the spacing between them to be adjusted. The carriages can be preset before a casting operation according to the width of the casting rolls and to allow quick roll changes for differing strip widths. Carriages 104 may be positioned supported by a core nozzle plate 106, which is mounted on the roll cassette 11 so as to extend horizontally above the casting rolls. The core nozzle plate 106 is positioned beneath the distributor 16 in the casting position and has a central opening 107 to receive the metal delivery nozzle 17. As shown in FIG. 4, two delivery nozzles 17 may be provided each capable of moving independently of the other above the casting rolls 12. A portion of each delivery nozzle 17 may be supported by delivery nozzle supports 108 inwardly projecting from the mid part of the core nozzle plate 106. The outer end of each delivery nozzle 17 is supported by a bridge 108 movably positioned on each carriage 104. The second actuators 110, such as a hydraulic or pneumatic cylinder, servo mechanism, or other actuator may be positioned capable of moving the bridges 108 and delivery nozzle 17 independent of the side dams 20.

In each carriage, a location sensor 112 may be positioned capable of determining the position of the side dam holder 100 and side dam 20 and providing electrical signals indicative of the position of the side dam holder and side dam plate. Additionally, a location sensor 113 may be positioned capable of determining the position of the bridge 108 and delivery nozzle 17 and providing electrical signals indicative of the position of the bridge and delivery nozzle. A force sensor, or load cell 114, may be positioned between the side dam holder 100 and side dam actuator 102 capable of determining the force urging the side dam 20 against the casting rolls 12 and providing electrical signals indicative of the force urging the side dam plate against the casting rolls. A controller is provided capable of receiving electrical signals from the location sensors 112, 113 and the load cell 114, and capable of causing the side dam actuators 102 and second actuators 110 to move toward or away from the casting rolls responsive to the electrical signals from the location sensors and load cells as desired. The controller may cause the side dam actuator 102 to move the side dam holder 100 independently of the movement and position of the bridge 108 and delivery nozzle 17. Alternately or in addition, the controller may cause the second actuator 110 to move the bridge 108 independently of the movement and position of the side dam holder 100 and side dam 20.

As the side dam wears, the controller may determine by monitoring electrical signals received from the location sensors 112, 113 movement of the side dam 20 increasing or decreasing the distance between the side dam and the delivery nozzle 17. The controller may determine that the distance between the side dam and the delivery nozzle is greater or less than a desired distance. Then, the controller or an operator may cause the second actuator 110 to move the bridge 108 to decrease or increase the distance between the side dam 20 and the delivery nozzle 17 as desired independently of the side dam 20.

FIG. 1 shows the twin roll caster producing the thin cast strip 21, which passes across a guide table 30 to a pinch roll stand 31, comprising pinch rolls 31A. Upon exiting the pinch roll stand 31, the thin cast strip may pass through a hot rolling mill 32, comprising a pair of work rolls 32A, and backup rolls 32B, forming a gap capable of hot rolling the cast strip delivered from the casting rolls, where the cast strip is hot rolled to reduce the strip to a desired thickness, improve the strip surface, and improve the strip flatness. The work rolls 32A have work surfaces relating to the desired strip profile across the work rolls. The hot rolled cast strip then passes onto a run-out table 33, where it may be cooled by contact with a coolant, such as water, supplied via water jets 90 or other suitable means, and by convection and radiation. In any event, the hot rolled cast strip may then pass through a second pinch roll stand 91, comprising second pinch rolls 91A, to provide tension of the cast strip, and then to a coiler 92. The cast strip may be between about 0.3 and 2.0 millimeters in thickness before hot rolling.

At the start of the casting operation, a short length of imperfect strip is typically produced as casting conditions stabilize. After continuous casting is established, the casting rolls are moved apart slightly and then brought together again to cause this leading end of the cast strip to break away forming a clean head end of the following cast strip. The imperfect material drops into a scrap receptacle 26, which is movable on a scrap receptacle guide. The scrap receptacle 26 is located in a scrap receiving position beneath the caster and forms part of a sealed enclosure 27 as described below. The enclosure 27 is typically water cooled. At this time, a water-cooled apron 28 that normally hangs downwardly from a pivot 29 to one side in the enclosure 27 is swung into position to guide the clean end of the cast strip 21 onto the guide table 30 that feeds it to the pinch roll stand 31. The apron 28 is then retracted back to its hanging position to allow the cast strip 21 to hang in a loop beneath the casting rolls in enclosure 27 before it passes to the guide table 30 where it engages a succession of guide rollers.

An overflow container 38 may be provided beneath the movable tundish 14 to receive molten material that may spill from the tundish. As shown in FIG. 1, the overflow container 38 may be movable on rails 39 or another guide such that the overflow container 38 may be placed beneath the movable tundish 14 as desired in casting locations. Additionally, an overflow container may be provided for the distributor 16 adjacent the distributor (not shown).

The sealed enclosure 27 is formed by a number of separate wall sections that fit together at various seal connections to form a continuous enclosure wall that permits control of the atmosphere within the enclosure. Additionally, the scrap receptacle 26 may be capable of attaching with the enclosure 27 so that the enclosure is capable of supporting a protective atmosphere immediately beneath the casting rolls 12 in the casting position. The enclosure 27 includes an opening in the lower portion of the enclosure, lower enclosure portion 44, providing an outlet for scrap to pass from the enclosure 27 into the scrap receptacle 26 in the scrap receiving position. The lower enclosure portion 44 may extend downwardly as a part of the enclosure 27, the opening being positioned above the scrap receptacle 26 in the scrap receiving position. As used in the specification and claims herein, "seal," "sealed," "sealing," and "sealingly" in reference to the scrap receptacle 26, enclosure 27, and related features may not be a complete seal so as to prevent leakage, but rather is usually less than a perfect seal as appropriate to allow control and support of the atmosphere within the enclosure as desired with some tolerable leakage.

A rim portion 45 may surround the opening of the lower enclosure portion 44 and may be movably positioned above the scrap receptacle, capable of sealingly engaging and/or attaching to the scrap receptacle 26 in the scrap receiving position. The rim portion 45 may be movable between a sealing position in which the rim portion engages the scrap receptacle, and a clearance position in which the rim portion 45 is disengaged from the scrap receptacle. Alternately, the caster or the scrap receptacle may include a lifting mechanism to raise the scrap receptacle into sealing engagement with the rim portion 45 of the enclosure, and then lower the scrap receptacle into the clearance position. When sealed, the enclosure 27 and scrap receptacle 26 are filled with a desired gas, such as nitrogen, to reduce the amount of oxygen in the enclosure and provide a protective atmosphere for the cast strip.

The enclosure 27 may include an upper collar portion 43 supporting a protective atmosphere immediately beneath the casting rolls in the casting position. When the casting rolls 12 are in the casting position, the upper collar portion 43 is moved to the extended position closing the space between a housing portion 53 adjacent the casting rolls 12, as shown in FIG. 2, and the enclosure 27. The upper collar portion 43 may be provided within or adjacent the enclosure 27 and adjacent the casting rolls, and may be moved by a plurality of actuators (not shown) such as servo-mechanisms, hydraulic mechanisms, pneumatic mechanisms, and rotating actuators.

A roll chock positioning system is provided on the main machine frame 10 having two pairs of positioning assemblies 50, 51 adapted to enable movement of the casting rolls on the cassette 11 and provide biasing forces resisting separation of the casting rolls during casting. The positioning assemblies 50, 51 may include actuators such as mechanical roll biasing units or servo-mechanisms, hydraulic or pneumatic cylinders or mechanisms, linear actuators, rotating actuators, magnetostrictive actuators or other devices for enabling movement of the casting rolls and resisting separation of the casting rolls during casting.

The casting surfaces 12A of casting rolls 12 are machined with an initial crown to allow for thermal expansion when the rolls are in use, typically such that the thickness of edge portions of the cast strip are thinner than the thickness at the center portion of the strip width. Different crowns may be provided according to the casting speed. The same degree of concave crown is provided in both the copper sleeve of the casting roll defining the outer periphery of the roll surface, and in the plating layer of chrome, nickel, or other coating material provided over the copper sleeve. The concave crown in the casting rolls may be selected to maintain a cross-sectional shape in the cast strip accounting for the thermal expansion of the casting rolls during casting, and at the same time, provide mushy center near the edges 22 of the cast strip during casting. The roll gap at the nip between the casting rolls is such that mushy metal is sandwiched at the center of the cast strip within 50 millimeters of edges 22 of the cast strip. The mushy metal at the center of the edge portions of the strip has fluidity and provides measurable edging up less than 0.2 millimeters so that the edging up may be rolled out of the strip with a pass through the hot rolling mill 32.

The crown shape of the casting rolls 12 in combination with the casting roll biasing force is capable of forming the cast strip having mushy metal between the shells enabling edge portions of the cast strip within 50 millimeters of edge of the cast strip to have a higher temperature than the cast strip in center portions of the strip width. Alternately, such edge portions of the cast strip within 60 millimeters of edge of the cast strip have a higher temperature than the cast strip in center portions of the strip width. The crown of the casting rolls 12 is shaped and the casting rolls are biased so that the casting rolls adjacent the edges 22 of the cast strip enable reheating of the solidified shells by the mushy metal within edge portions of the cast strip within 50 millimeters of the edges 22 to a temperature higher than in the center portions of the strip width. The temperature of the edge portions of the cast strip may be about 10° C. or more higher than the cast strip in the center portions of the strip width. Alternately or in addition, the temperature of edge portions of the cast strip may be about 25° C. or more higher than the cast strip in the center portions of the strip width, or may be about 50° C. or more higher than the cast strip in the center portions of the strip width.

This crown shape of the casting rolls, with appropriate biasing in the casting rolls and the side dams (as discussed below), controls of the amount of mushy metal between the shells below the nip and the edging up or edge bulge in the cast strip as desired. By shaping the concave crown in the casting rolls to bring the solidified shells closer together at their edges at the nip between the casting rolls, the mushy metal present in the strip thickness below the nip within 50 millimeters of the edges 22 can be controlled to provide reheating of the solidified shells, and in conjunction with the ferrostatic head, to cause controlled edging up.

We have found that maintaining a higher temperature at the edge portions of the cast strip and maintaining a controlled edging up improves the edge quality of the cast strip. When strip edges 22 are cooled to a temperature at or lower than the temperature of the center portions of the strip width before hot rolling, the microstructure and properties of the hot rolled cast strip vary across the width after hot rolling, particularly at the edges 22. To prevent variation in microstructure and physical properties when strip edges 22 are cooled to or at temperatures lower than the temperature of the center portions of the strip width, heaters must be provided along the cooled edge portions of the cast strip before the hot rolling mill to re-heat the edges to a desired hot rolling temperature. See, Developments in Continuous Casting and Hot Rolling Techniques, "*EUROSTRIP—State of the Art of Strip Casting*" by Dr. -Ing Hans-Ulrich Lindenberg, Jacques Henrion, Karl Schwaha and Giovanni Vespasiani. In contrast, by maintaining the edge portions at a higher temperature with the mushy metal between the shells below the nip, microstructure and physical properties can be maintained across the strip width without re-heating the edges of the strip. In addition, more even reduction may be obtained through the hot rolling mill and reduced incidence of edge splitting during hot rolling by maintaining such higher temperature at the edge portions.

Figure 8A:
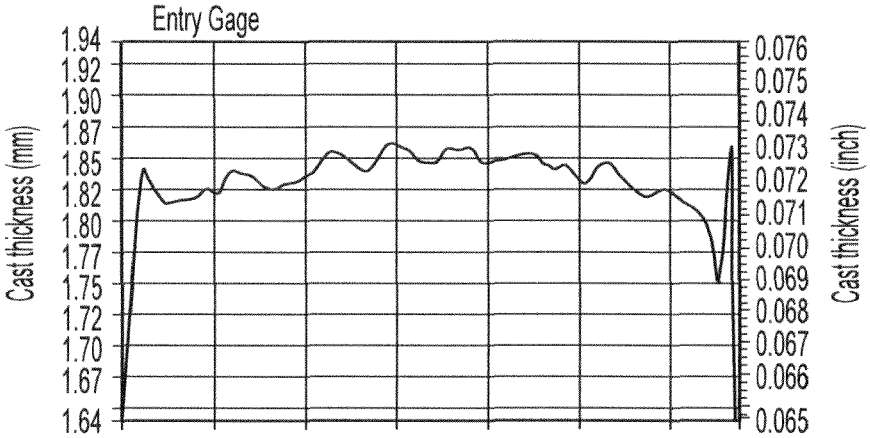
FIG. 8A is a graph showing measured thickness of cast strip across the strip width from a production sequence 1668.
Figure 8B:
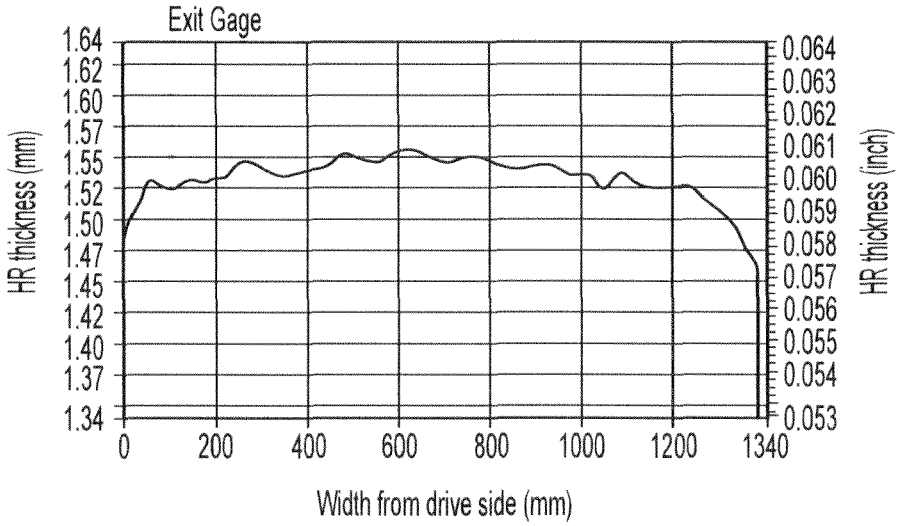
FIG. 8B is a graph showing measured thickness of cast strip across the strip width from a production sequence 1671.
Figure 10:
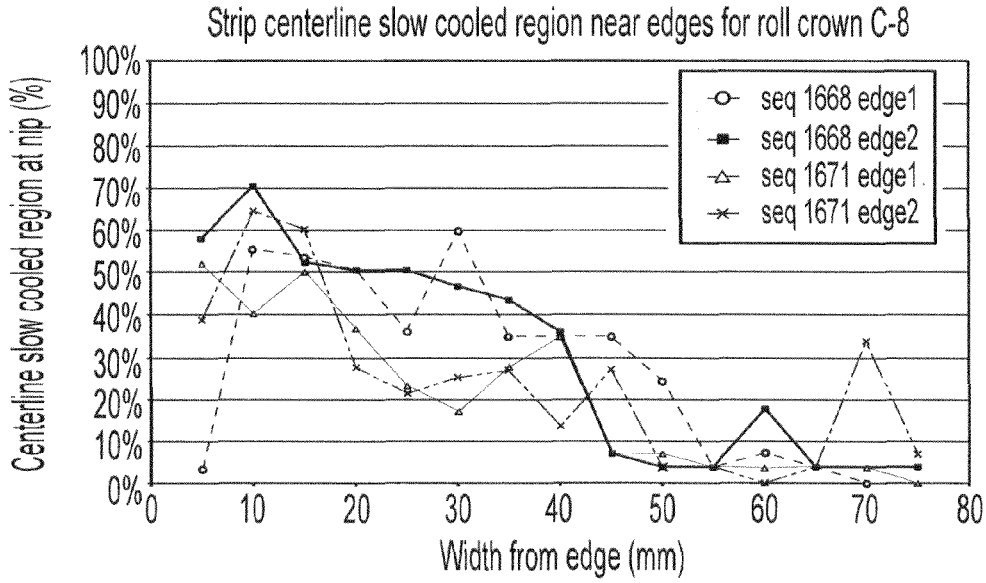
FIG. 10 is a graph showing percent slow cooled region at nip vs. width from edge.

As shown in FIG. 8A (sequence No. 4427), the solidified shells in a production run are brought closer together at the strip edges 22 by the concave crowns of the casting rolls so that the cast strip tends to reduce in thickness within about 100 millimeters of the edges, while providing mushy metal between the shells within about 50 millimeters of the edges 22. This results in a "slow cooled region" in the edge portions of the cast strip at the nip, meaning the cast strip has mushy metal in the strip thickness providing edging up as shown in FIG. 8A, which as shown by FIG. 8B can be rolled out of the strip by the hot rolling mill 32 downstream of the nip. FIG. 10 shows an amount of mushy steel in the cast strip as a percent of strip thickness determined from microstructure measurements taken at both edges 22 of cast strip from two different production runs (i.e., sequence 1668 and 1671) as the cast strip passes through the nip for a tested casting roll crown configuration.

Figure 9:
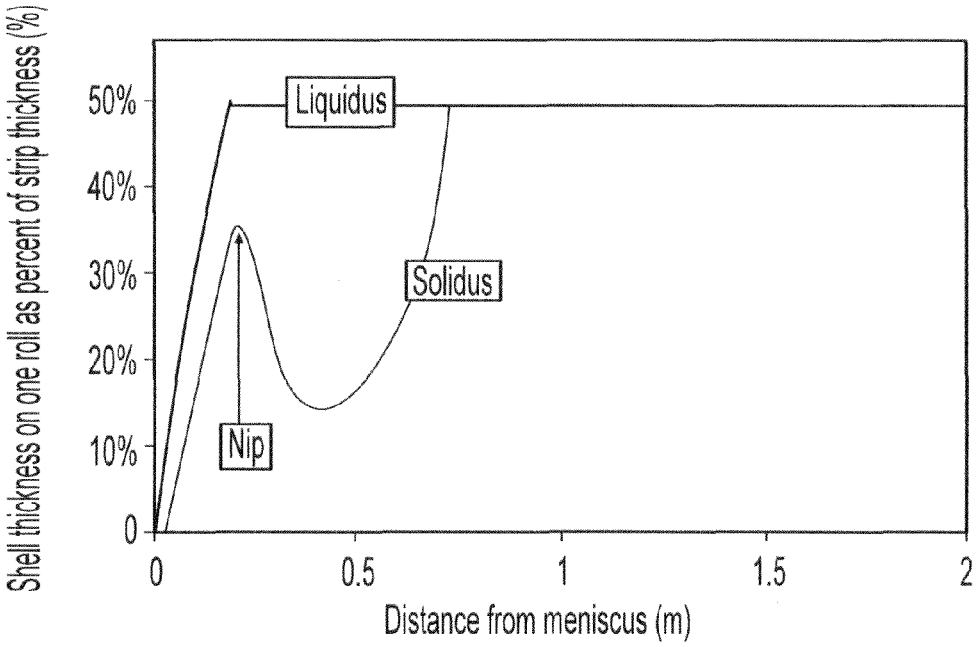
FIG. 9 is a graph showing shell thickness vs. distance from the meniscus of the molten metal in the casting pool.

FIG. 9 illustrates generally the thickness variation of a solidified shell as the cast strip is cast. As the casting rolls 12 rotate into the casting pool, the shell begins to form and increases in thickness to the nip. In this experiment casting a strip of just under 1.6 millimeter thickness, as the cast strip passed through the nip, each shell was approximately 0.55 millimeters thick, and the mushy portion between the shells, resulting in a slow cooled region, was approximately 0.5 millimeters thick. As the cast strip left the nip, the heat from the mushy portion reheated the shells, reducing the shell thickness and having mushy metal between the shells below the nip for a distance of about 0.7 meters. Subsequently, the mushy metal in the edge portions is cooled and solidified as the strip moves away from the nip. This may also occur to some degree in the center portion of the strip width.

As shown in FIG. 10, the amount of mushy metal in the strip thickness after the strip passes through the nip increases within 10 millimeters of the edges of the strip, and then continually decreases to very low amount toward the center of the strip width well beyond 50 millimeters from the edges. When the strip edges have mushy metal, the surface of the strip also has a higher temperature because of reheating of the metal shells. As shown in FIG. 10, the solid fraction of metal in the strip thickness between the shells within about 50 mm of the edge of the cast strip is generally well below 80%. This is with carbon steel strip. By contrast, in U.S. Pat. No. 6,079,480 and EP 0788854 it is taught that for carbon steels the fluid critical solid fraction is 0.8, which means the solid fraction of the strip is at least 80% within 50 millimeters of the edges of the strip.

The merit the presently claimed method and apparatus for making thin cast strip is also evident from comparing FIG. 8A, showing cast strip made with the presently claimed method and apparatus, with Table 3 in U.S. Pat. No. 6,079,480 and EP 0788854. As shown in FIG. 8A, mushy material in the strip within 50 millimeters of the edge of the strip is purposely maintained and edging up is controlled by the present method and apparatus. By contrast, Table 3 in U.S. Pat. No. 6,079,480 and EP 0788854 shows that the solid fraction of the cast strip was acceptable only where the strip edges within 50 millimeters are above the critical solid fraction and there was a zero edging up height (in millimeters).

We also contemplate that with austenitic stainless steel, ferrite stainless steel, electrical magnetic steel the mushy material within 50 millimeters of the edge of the strip has a solid fraction of less than 70%, 40% and 30% respective in the present method and apparatus for making thin cast strip. Again this is in contrast to the thin cast strip made of the method and apparatus described in U.S. Pat. No. 6,079,480 and EP 0788854 where the solid fraction is at or above the fluid critical solid fraction of 0.3 for austenitic stainless steel, of 0.6 for ferrite stainless steel, and 0.7 of for electrical magnetic steel. Also as shown by Table 2 of U.S. Pat. No. 6,079,480 and EP 0788854, the strip ferrite stainless steel is only acceptable where the solid fraction of the cast strip provides zero edging up height (in millimeters).

Figure 11:
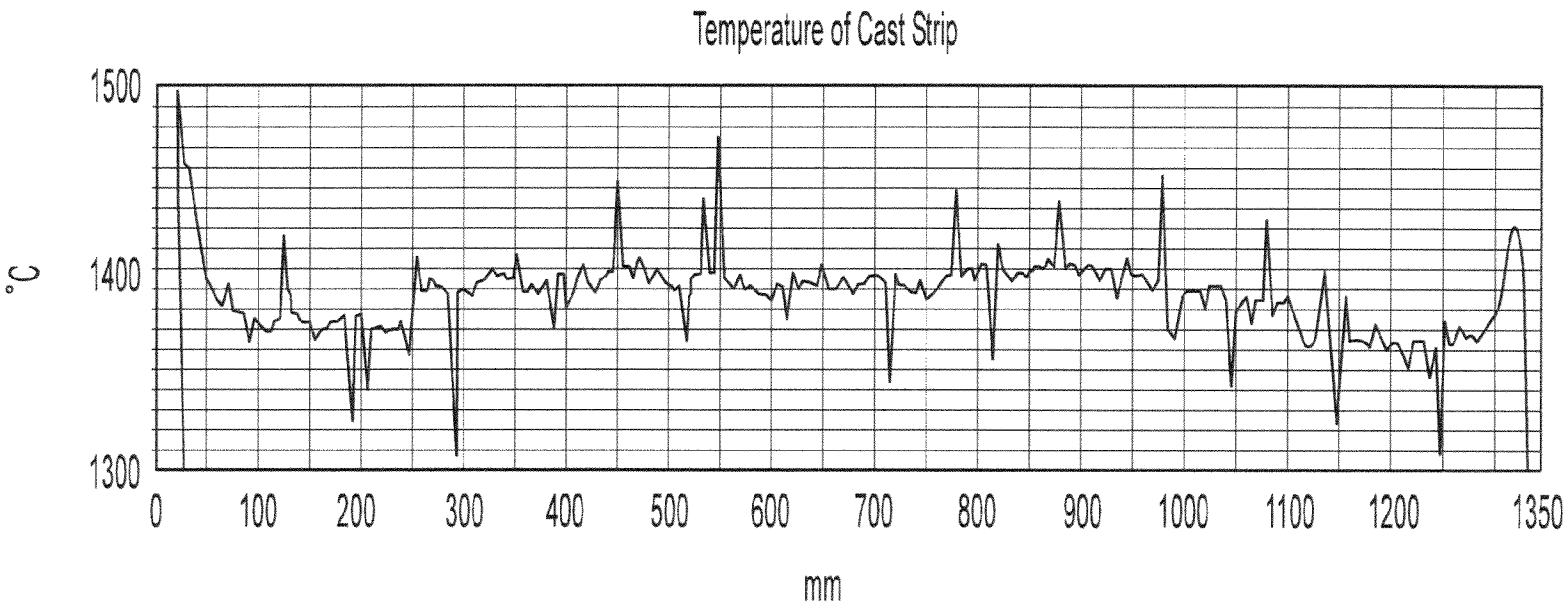
FIG. 11 is a graph showing temperature of the cast strip along the strip width.
Figure 12:
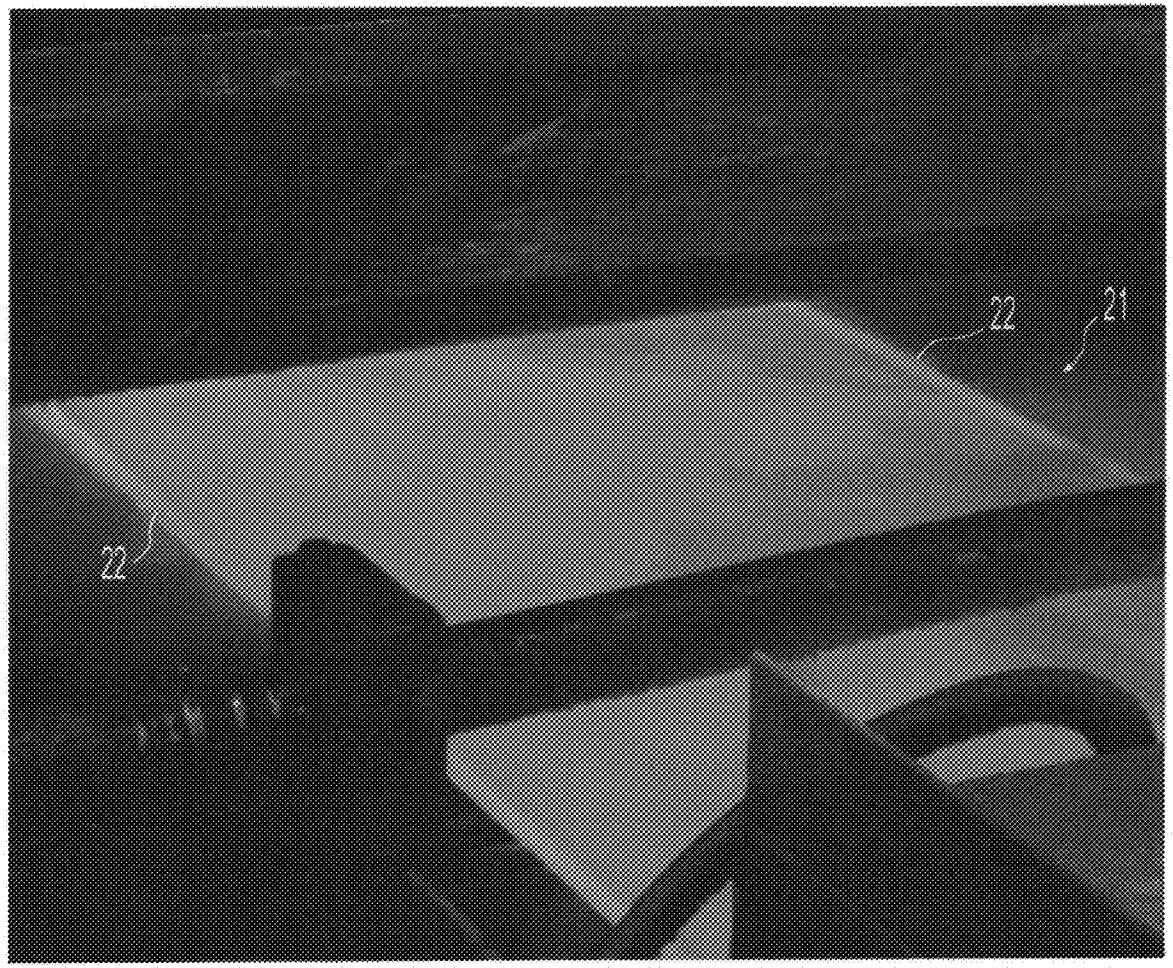
FIG. 12 is a diagrammatical perspective view showing cast strip leaving the caster having higher temperatures at the edges than along the width.
Figure 13:
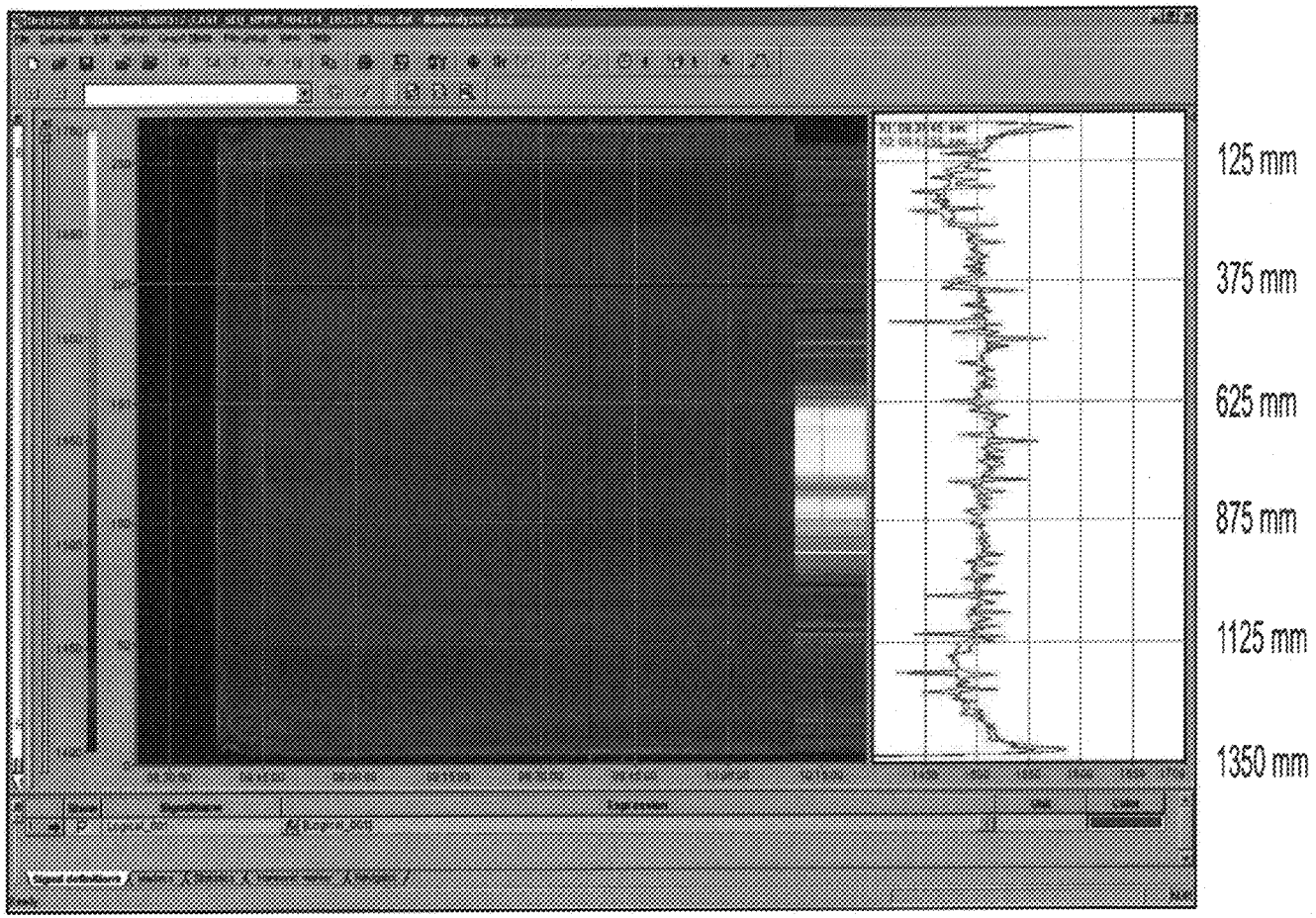
FIG. 13 is a second graph showing temperature of the cast strip along the strip width.

As indicated by FIG. 12, at least a portion of the slow cooled region of the cast strip downstream from the nip may be visible to the eye due to a difference in the color of the metal along the edges of the strip. The hotter edges of the cast strip are a brighter orange-red color than the center portion of the strip width. As shown in FIGS. 11 and 13, the temperature at the edges 22 of the strip is higher than the center portion of the strip width downstream of the nip 18. FIG. 13 shows in color the temperature profile of the cast strip across the width. The temperatures of the strip are noted by color gradation at the left side of the image and the temperatures read by comparison of the strip color with the color scale.

By controlling the amount of mushy metal in the strip thickness along the edge portions, a higher temperature at the edge portion can be maintained and edging up controlled. When edging up is not controlled, the cast strip may have irregular edges such as edge splitting or edge loss. Further, progressively increasing edge loss may form edge whiskers, or elongated portions of metal along the edge. Edge whiskers can break off and stick to the casting rolls and other portions of the caster during casting. Such edge loss may also cause difficulty controlling the direction of, or steering, the cast strip through the caster, requiring termination of casting. We have found that edge quality can be controlled by maintaining higher temperatures in the edge portions of the cast strip, and controlling the mushy material with edging up in the edge portions of the cast strip as desired.

Figure 15:
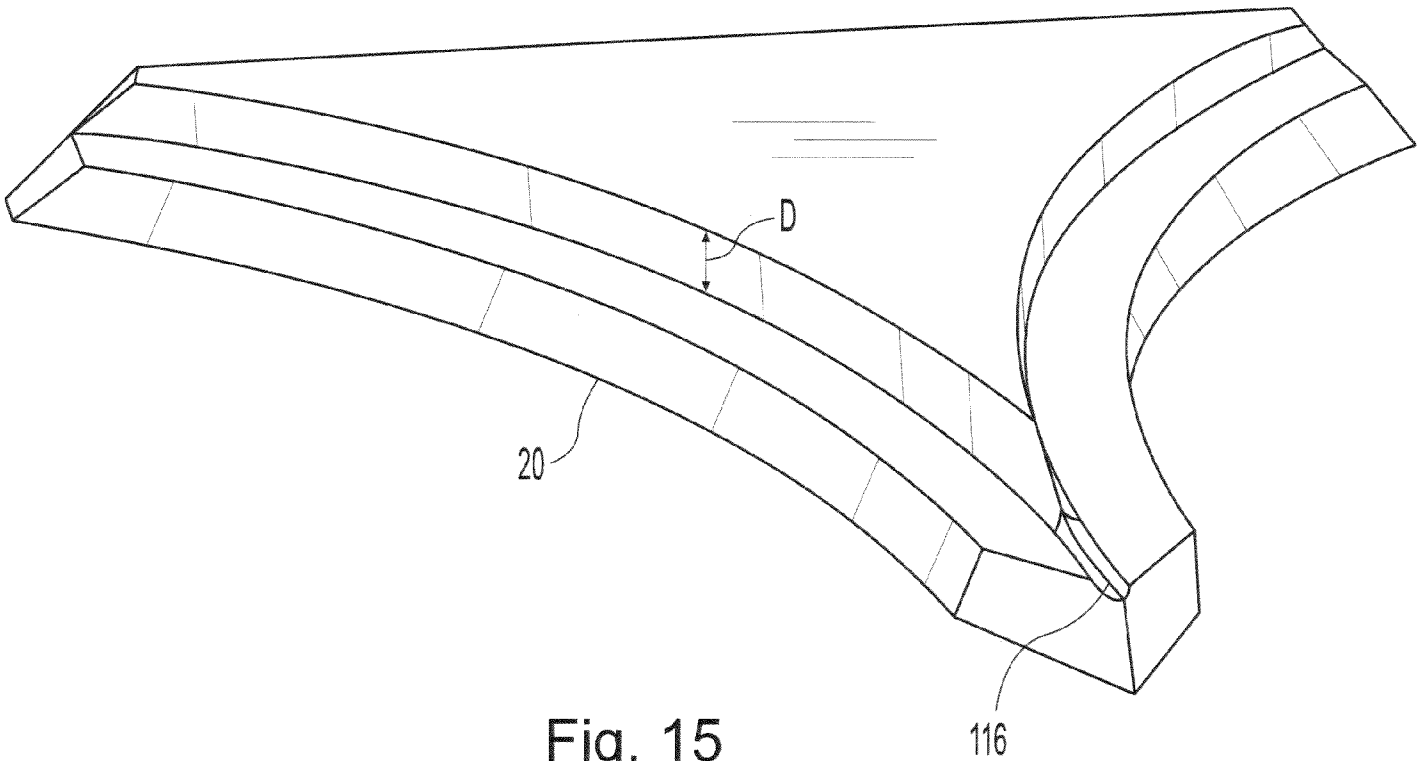
FIG. 15 is a diagrammatical perspective view of a side dam having a groove worn in the refractory.

During casting, the cast strip may wear a groove 116 in the face surfaces corresponding to the cast strip adjacent the nip as shown in FIG. 15. As used here, the face surfaces are the surfaces of the side dam positioned against the end of the casting rolls. As the groove 116 is in communication with the ferrostatic head of the casting pool, mushy metal may pass through the groove as the groove increases in depth, creating edge loss. During casting, the amount of mushy material lost through the edge of the cast strip below the nip may be controlled by limiting the depth of the groove 116 in each side dam to less than about 2.5 millimeters. When the depth of the groove 116 exceeds a desired depth, the controller or an operator may cause the side dam actuators to change the biasing forces on the side dams 20 causing the refractory material of the side dam to wear away as indicated by reference "D" in FIG. 15. As the face surfaces wear away, the depth of the groove decreases. The depth of the groove 116 may be controlled to be in the range of about 0.2 millimeters to about 2.5 millimeters. Alternately, the edge portions may be controlled by limiting the depth of the groove 116 in each side dam to less than about 1.5 millimeters.

A method of casting strip may include the step of controlling a groove formed into at least one side dam by the cast strip during casting to less than about 2.5 millimeters. Alternately or in addition, the method of casting strip may include the step of causing the side dam actuator 102 to move the side dam 20 toward the end of the casting roll 12 when the groove 116 formed into at least one side dam by the cast strip during casting is greater than about 2.5 millimeters. Alternately, the method may include causing the side dam actuator 102 to move the side dam 20 toward the end of the casting roll 12 when the groove 116 wearing into the side dam, by the cast strip, is greater than about 1.5 millimeters. Each side dam actuator may be capable controlling the wear rate of the side dam to control the depth of the groove to less than 2.5 millimeters or 1.5 millimeters to inhibit edge loss.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A method of continuously casting metal strip comprising:

assembling a pair of counter-rotatable casting rolls having casting surfaces laterally positioned to form a nip therebetween through which thin cast metal strip is cast, a metal supply system capable of delivering molten steel above the nip, the casting rolls having a crown shape so that each edge portion of the metal strip within 50 millimeters of each edge of the metal strip has a higher temperature than the metal strip in center portions of the strip width;

forming a casting pool of molten steel supported on the casting surfaces above the nip in a casting area and controlling side dams adjacent the ends of the nip to confine the casting pool; and forming a metal strip such that each edge portion of the metal strip within 50 millimeters of each edge of the metal strip is of a higher temperature than the metal strip in the center portions of the strip width.

2. The method of continuously casting metal strip as claimed in claim 1 further comprising:

each edge portion of the metal strip between 50 and 60 millimeters of each edge of the metal strip has a higher temperature than the metal strip in the center portions of the strip width.

3. The method of continuously casting metal strip as claimed in claim 1 further comprising:

forming the metal strip such that each edge portion of the metal strip within 50 millimeters of each edge of the metal strip below the nip has mushy metal.

4. The method of continuously casting metal strip as claimed in claim 1 where the temperature of each edge portion of the metal strip is about at least 25° C. higher than the metal strip in the center portions of the strip width.

5. The method of continuously casting metal strip as claimed in claim 1 where the temperature of each edge portion of the metal strip is at least about 10° C. higher than the metal strip in the center portions of the strip width.

6. The method of continuously casting metal strip as claimed in claim 3 further comprising:

controlling a groove formed into at least one side dam by the metal strip during casting to less than about 2.5 millimeters.

7. The method of continuously casting metal strip as claimed in claim 3 further comprising:

controlling a groove formed into at least one side dam by the metal strip during casting to less than about 1.5 millimeters.

8. The method of continuously casting metal strip as claimed in claim 3 further comprising:

controlling the amount of mushy metal between shells of the metal strip below the nip to control and maintain edge bulge as desired.

9. The method of continuously casting metal strip as claimed in claim 1 further comprising:

providing a side dam actuator capable of positioning at least one side dam during casting.

10. The method of continuously casting metal strip as claimed in claim 9 further comprising:

causing the side dam actuator to move the side dam toward the end of the casting rolls when a groove formed in at least one side dam by the metal strip during casting is greater than about 2.5 millimeters.

11. The method of continuously casting metal strip as claimed in claim 9 further comprising:

causing the side dam actuator to move the side dam toward the end of the casting rolls when a groove formed in at least one side dam by the metal strip during casting is greater than about 1.5 millimeters.

12. An apparatus for continuously casting metal strip comprising:

a pair of counter-rotatable casting rolls having casting surfaces laterally positioned to form a nip therebetween through which thin cast metal strip is cast, the casting rolls having a crown shape providing each edge portion of the metal strip within 50 millimeters of each edge of the metal strip internally heated to provide the edge portion of the strip with a higher temperature than the metal strip in center portions of the strip width; and a metal supply system capable of delivering molten steel above the nip and forming a casting pool of molten steel supported on the casting surfaces above the nip in a casting area;

a side dam adjacent each end of the casting rolls at the nip to confine the casting pool; and a side dam actuator at each end of the casting rolls capable of positioning the side dams during casting and controlling a groove formed into at least one side dam by the metal strip during casting to less than about 2.5 millimeters.

13. The apparatus for continuously casting metal strip as claimed in claim 12 where further comprising:

the crown shape of the casting rolls is capable of forming a metal strip such that the edge portions of the strip between 50 and 60 millimeters of each edge of the metal strip is of a higher temperature than the metal strip in the center portions of the strip width.

14. The apparatus for continuously casting metal strip as claimed in claim 12 where the crown shape of the casting rolls is capable of forming the metal strip such that each edge portion of the strip within 50 millimeters of each edge of the metal strip below the nip has mushy metal.

15. The apparatus for continuously casting metal strip as claimed in claim 14 where the side dam actuator at each end of the casting rolls is capable of controlling the wear rate of the side dam to control the depth of the groove.

16. The apparatus for continuously casting metal strip as claimed in claim 12 where the temperature of each edge portion of the metal strip is at least 25° C. higher than the metal strip in the center portions of the strip width.

17. The apparatus for continuously casting metal strip as claimed in claim 12 where the temperature of each edge portion of the metal strip is at least about 10° C. higher than the metal strip in the center portions of the strip width.

18. The apparatus for continuously casting metal strip as claimed in claim 12 where the side dam actuator at each end of the casting rolls is capable of positioning the side dams during casting and controlling a groove formed into at least one side dam by the metal strip during casting to less than about 1.5 millimeters.

* * * * *